United States Patent [19]

Larcen

[11] 4,035,133

[45] July 12, 1977

[54] ROTARY BURNER CONTROL

[76] Inventor: Donald W. Larcen, 2417 Grenoble Road, Richmond, Va. 23229

[21] Appl. No.: 664,214

[22] Filed: Mar. 5, 1976

[51] Int. Cl.[2] ..... F23M 1/02

[52] U.S. Cl. ..... 431/12; 239/262; 431/4; 431/168; 431/90

[58] Field of Search ..... 431/4, 8, 9, 12, 168, 431/90, 190; 239/251, 262

[56] References Cited

U.S. PATENT DOCUMENTS

| | | | |
|---|---|---|---|
| 2,536,379 | 1/1951 | Linden | 431/4 |
| 3,771,940 | 11/1973 | Stranahan | 431/90 X |
| 3,843,310 | 10/1974 | Massi | 431/90 |
| 3,844,705 | 10/1974 | Miyahara | 431/190 X |

*Primary Examiner*—Edward G. Favors
*Attorney, Agent, or Firm*—Griffin, Branigan & Butler

[57] ABSTRACT

A system and method for controlling a rotary burner of the type in which attempts have been made to maintain predetermined differential pressures between steam and fuel delivered thereto. The fuel flow is adjusted to provide a given heat release; and without regard to pressure, the steam flow is adjusted in accordance with a predetermined ratio to correspond to the given fuel flow.

15 Claims, 5 Drawing Figures

ROTARY BURNER CONTROL

BACKGROUND OF THE INVENTION

This invention relates to an improved control system for rotary gas and oil burners of the type described, for example, in U.S. Pat. Nos. 2,177,225; 2,351,421 and the like. In this respect, such burners produce rotary motion by discharge of gaseous or atomized liquid fuel under pressure; and, the rotary or "fan" motion serves not only for propulsion of combustion-supporting air, but also for effecting an intimate and homogeneous admisture of fuel and air.

FIG. 1 illustrates a typical rotary burner of the type with which the invention finds particular utility. Therein, a main shaft 10 is mounted for rotary motion within suitable bearings, not shown; and, steam and gas or a liquid fuel such as oil are directed through passageways 12, 14, 16, and 17 located within the shaft 10. Typical structures also include suitable controls so that the burner can be selectively fueled by either liquid or gaseous fluids. For purposes of simplicity, however, such details are not shown in the FIG. 1 schematic illustration.

In the typical rotary burner the steam lines include one or more venturi sections 18 having a throat portion 20 and a diffuser portion 22 which is connected through channels such as 24 to outlet ports 26 in arms 28 connected to a fan, not shown. In this manner, the fuel, steam and the fan's air are all directed into the flame zone 34 located to the left of the fan in the schematic illustration if FIG. 1. At the same time, steam is directed to a cavity 30 for cooling purposes.

In operation, as the steam passes through the throat 20 of the venturi 18 it is expected to pull oil through orifice 36 from passageway 16. The oil-steam mixture is then forced into the passageways 24 and out of ports 26, causing the fan to rotate and pull air into the flame zone 34.

Further details of suitable rotary burners can be found in publicly available trade publications such as *Catalogue* 500 *A* (March 1972) of the Coppus Engineering Corporation, 344 Park Avenue, Worcester, Mass. 01610; or *Manual* 230, published by the same corporation.

During operation of rotary burners, the flows of fuel, steam, and air are adjusted to provide stoichiometric mixtures or variations therefrom in order to provide the desired flame in the burn zone. These adjustments are conventionally initially performed manually in order to determine suitable "set points" for the burner controls with the expectation that, thereafter, the burner's various flow rates will be automatically adjusted as the burner's firing rate is changed. In this respect, particularly where the burner is fueled by oil, satisfactory operation requires that the steam pressure be higher than that of the fuel pressure as illustrated in FIG. 2; and, the required differential between the two pressures increases with the burner's firing rate (fuel flow). Hence, particularly with today's emphasis upon ecological considerations and the increased emphasis upon fuel economy, it is desired that the fuel-steam pressure differentials be accurately controlled during automatic operation so as to provide a low-smoke flame having high heat release.

One structure for controlling the steam-fuel pressure differential is illustrated in FIG. 3. Therein, a pressure differential sensor-transmittor 40 measures the pressure differential between fuel line 42 and steam line 44. Then, as the burner's firing rate is changed by means of a fuel pressure control valve 46, the steam pressure is adjusted by manual operation of a ratio controller 48 which operates through a pressure differential controller 50 to adjust a diaphragm-type steam-pressure control valve 52. In this respect, the ratio control 48 is initially manually adjusted by visual inspection of the burner flame over the full firing range of the burner. Thereafter, during desired automatic operation, as fuel pressure is changed to vary the burner's firing rate, the pressure differential controller 50 is expected to be operative in response to signals from the pressure differential sensor 40 and the ratio controller 48 to automatically adjust the steam pressure valve 52.

The FIG. 3 structure, however, is unstable so that efficient burner operation is sporadic. That is, fuel pressures tend to vary from those which are expected. Hence, a fuel pressure sensor and control mechanism 54 was inserted in the fuel control line 56 in an effort to adjust the setting of fuel pressure control valve 46 as the unstable fuel pressure changes from that which is desired.

Even the addition of a pressure controller such as 54, however, results in an unstable flame having less than the desired efficiency. A primary object of the instant invention, therefore, is to provide an improved method of automatically controlling a rotary burner wherein the instabilities of the above described systems are substantially eliminated; and, it is another object of the invention to provide an improved rotary burner control system wherein the costs thereof are not prohibitive. In this regard, one of the advantages of the structure about to be described is that it is not only price-competitive with prior devices, but provides more efficient control at less cost than the systems described above.

SUMMARY OF THE INVENTION

In accordance with broader aspects of the invention, the steam-fuel pressure differential is only indirectly controlled. That is, first the burner's steam flow is adjusted over an anticipated range of fuel flows by visual inspection of the burner flame in a manner similar to that described above. Then, from prior operating data and/or stoichiometric calculations, a determination is made of the amount of fuel flow required for a desired heat release. Then, without regard to the fuel-steam pressure differential, the actual fuel flow is simply measured and the steam flow is adjusted in accordance with the fuel/steam flow ratios that were determined during the initial steam flow adjustments as the fuel flow was changed over its anticipated flow-range.

BRIEF DESCRIPTION OF THE DRAWINGS

The foregoing and other objects, features, and advantages of the invention will be apparent from the following more particular description of preferred embodiments of the invention as illustrated in the accompanying drawings, wherein reference characters refer to the same parts throughout the various views. The drawings are not necessarily drawn to scale. Instead, they are merely presented so as to illustrate principles of the invention in a clear manner.

DETAILED DESCRIPTION

Figure 3:
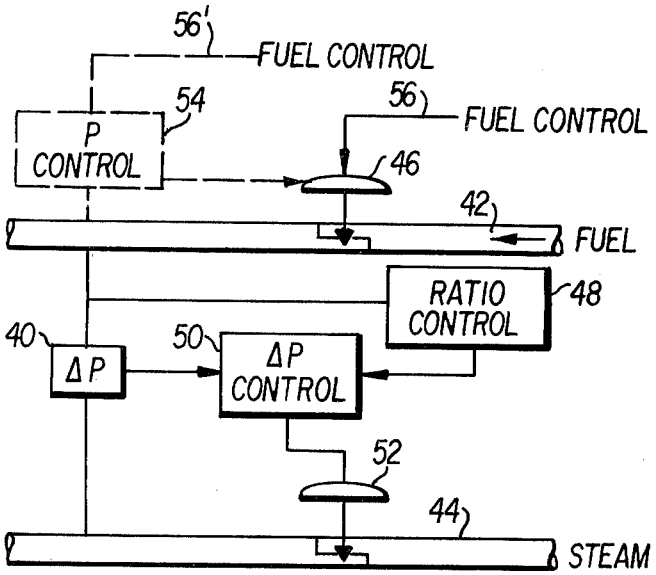
FIG. 3 is a schematic illustration of structure that has previously been used in attempts to control the steam-fuel pressure differential in rotary burners.

During operation of a structure such as that described above in connection with FIG. 3, the pressure variations in the fuel line were of such a frequency and magnitude that conventional control elements could not provide adequate damping. Possibly these pressure variations were caused by cavitation at the venturis, or carbonization at the fan arm holes 26, but, in any event such operation did not result in the desired fuel efficiency and flame stability. Moreover, even with the addition of a separate fuel pressure control mechanism such as 54, it was noted that increases in steam pressure actually caused large surges in the system's fuel pressure — quite the opposite of what one would normally expect in view of the venturi section 18 in the steam line 12. The structure of FIG. 5, therefore, was developed in order to reduce the effects of these phenomena upon the burner's control system.

Figure 5:
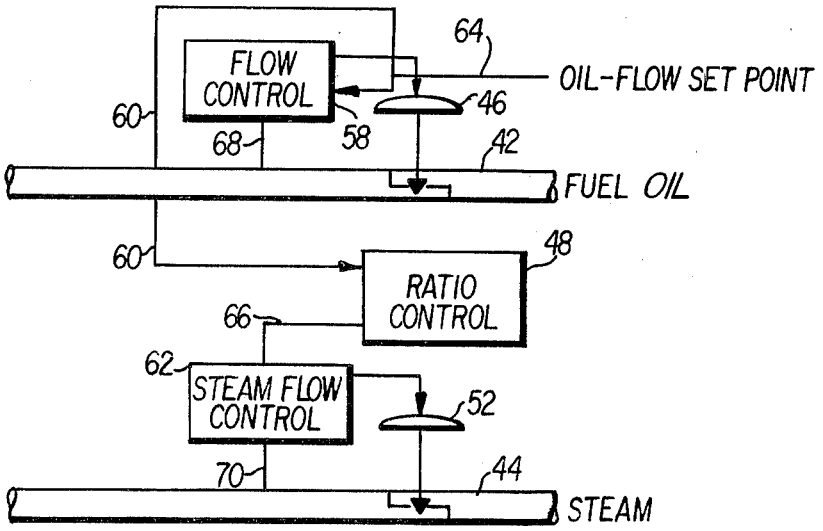
FIG. 5 is a schematic illustration of a control system according to the invention.

In FIG. 5, a flow control device 58 is operative in response to an oilflow set point signal on line 64, from a conventional means not shown, to adjust a diaphragm-type fuel flow control valve 46 to deliver fuel at a previously determined number of pounds per hour. The oil-flow set point signal is also delivered on line 60 to the ratio controller 48 which is connected to the steam flow-control valve 52 through a steam flow controller 62. The system does not require a pressure differential sensing mechanism for determining the pressure differential between the fuel and steam lines.

In operation, various stoichiometric calculations are conducted and sample operational runs are completed in order to determine the amount of fuel flow that is required to produce a desired heat release for a given ultimate condition such as boiler temperature, boiler pressure, engine speed, or the like. This information is used to generate a curve such as that illustrated in FIG. 4. Thereafter, signals corresponding to the various anticipated fuel flows are delivered on line 64 to the flow control device 58 and the ratio controller 48. The fuel flow control valve 46 is then adjusted accordingly; and, for each new setting of valve 46, the steam control valve 52 is manually adjusted to obtain the desired flame as determined by visual examination thereof.

Figure 1:
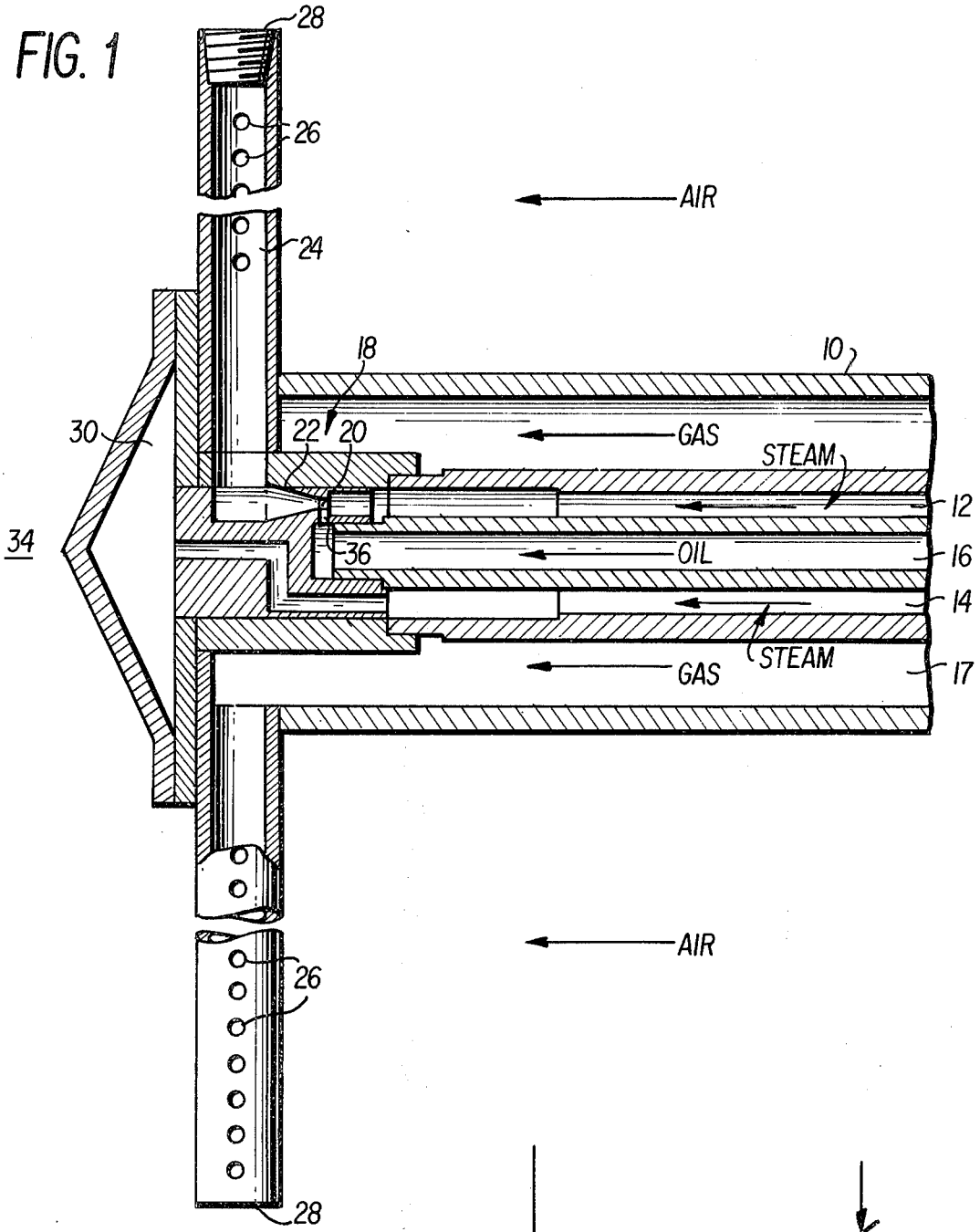
FIG. 1 is a schematic illustration of a rotary burner of the type with which the invention finds particular utility.
Figure 2:
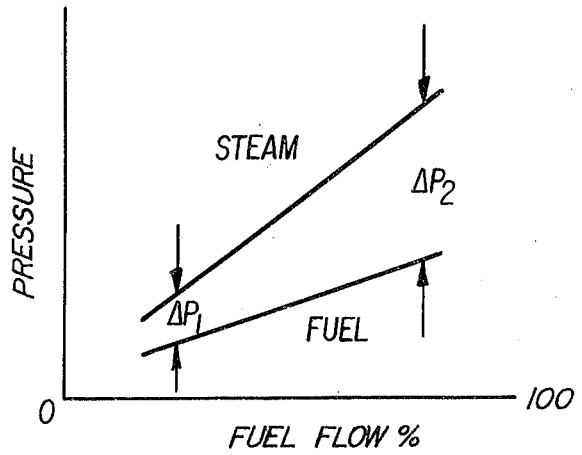
FIG. 2 is a graph illustrating changes in the fuel-steam pressure differential in a burner of the type illustrated in FIG. 1.
Figure 4:
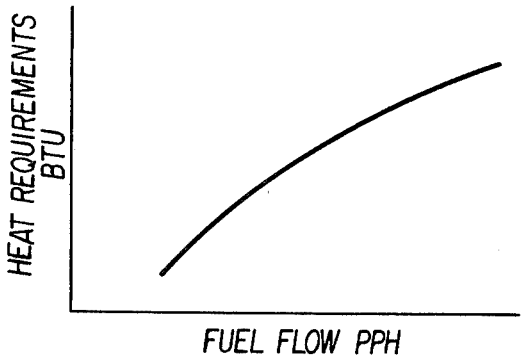
FIG. 4 is a graph illustrating a typical burner's variation in fuel flow with changes of the burner's heat requirements.

After the system is adjusted as described above, flow signal is delivered on line 64 to flow controller 58 in accordance with the desired heat requirements as determined from FIG. 4. The same oil-flow setpoint signal is delivered on line 60 to the ratio controller 48 which delivers a corresponding signal on line 66 to the steam flow controller 62 in accordance with the flow ratio that was determined during the visual flame adjustment step described above. The flow controller 58 then adjusts the fuel flow control valve 46; and, the steam flow controller 62 adjusts the steam valve 52 so that the steam-fuel flow ratio is controlled without regard to the pressure differential across the two lines. In this respect, however, it has been found that not only is the flame more stable than in previous devices, but the pressure differentials between the fuel and steam lines are substantially in accordance with those of FIG. 2 even though no attempt was made to directly control the pressure differential therebetween.

Additionally, the fuel flow controller 58 is adapted (by conventional means schematically illustrated by line 68) to monitor the fuel flow in line 42 to make adjustments in the position of fuel valve 46 in the event that actual fuel flow differs from the set point flow by more than a predetermined amount. Similarly, steam flow can be measured as represented by line 70 in the steam flow controller 62; and, the steam flow control valve 52 adjusted accordingly to account for undesired variations in steam flow from that which was previously determined by the ratio controller 48 which delivered a corresponding signal to the steam flow control mechanism along line 66.

While the invention has been particularly shown and described with reference to preferred embodiments thereof, it will be understood by those skilled in the art that various changes in form and detail may be made therein without departing from the spirit and scope of the invention. For example, the flow controls, and ratio devices can be electronic, pneumatic, or mechanical. Similarly, although the ratio control 48 has been described as being initially set during visual inspection of the burner flame, it will be appreciated by those skilled in the art that the initial adjustments can be accomplished by means of smoke detectors, automatic optical pyrometers, and the like.

The embodiments of the invention in which an exclusive property or privilege is claimed are defined as follows:

1. A method of operating a rotary burner of the type in which quantities of fuel and steam are controlled by respective steam-flow and fuel-flow control valves to deliver steam and fuel into an air stream through a rotating member, said method comprising the steps of:

determining the amount of fuel flow that is required thru said burner to produce various values of heat release;

adjusting a ratio-control device to provide an output signal level to said steam-flow control valve corresponding to a desired steam flow for each given fuel flow in a series of fuel flows;

setting said fuel-flow control valve to provide a flow of fuel corresponding to a desired heat release value; and regulating said steam flow in accordance with the previously adjusted output signal level from said ratio-control device corresponding to said desired heat release value.

2. The method of claim 1 including the step of modifying the setting of said fuel-flow control-valve to provide a modified flow of fuel corresponding to a different heat release value; and modifying said steam flow in accordance with the previously adjusted output signal level from said ratio-control device corresponding to said different heat release value.

3. The method of claim 1 including the step of monitoring said fuel flow and changing the setting of said fuel-flow control valve according to the amount by which the actual fuel flow varies from that corresponding to said desired heat release value; and changing said steam flow by a corresponding amount.

4. The method of claim 3 including the step of modifying the setting of said fuel-flow control valve to provide a modified flow of fuel corresponding to a different heat release value; and modifying said steam flow in accordance with the previously adjusted output signal level from said ratio control corresponding to said different heat release value.

5. The method of claim 3 including the step of monitoring said steam flow and changing the setting of said steam-flow control valve in accordance with variations in said steam flow from the previously determined steam flow corresponding to said desired heat release value.

6. The method of claim 5 including the step of modifying the setting of said fuel control to provide a modified flow of fuel corresponding to a different heat release value; and modifying said steam flow in accordance with the previously adjusted output signal level from said ratio-control device corresponding to said different heat release value.

7. A flow control mechanism in a rotary burner device comprising means for delivering fuel to said burner;

an adjustable fuel-flow valve for regualting the flow of fuel to said burner;

fuel-flow control means for adjusting the position of said fuel-flow valve;

means for delivering steam to said burner;

an adjustable steam-flow valve for regulating the flow of steam to said burner;

steam-flow control means for adjusting the position of said steam-flow valve; and, selectively settable ratio control means for providing an output signal to said steam-flow control means, there being a predetermined ratio of steam flow to fuel flow for any desired fuel flow within a given range of fuel flows, so that adjustment of said fuel-flow valve by said fuel-flow control means to deliver a desired amount of fuel to said burner, results in a corresponding steam flow to said burner in accordance with the predetermined ratio for the desired fuel flow.

8. The control mechanism of claim 7 wherein said fuel-flow control means includes means for sensing the actual flow of fuel to said burner and is adapted to change the adjustment of said fuel flow valve by an amount corresponding to that by which said actual fuel flow varies from the desired fuel flow.

9. The control mechanism of claim 8 including means for modifying the setting of said fuel-flow control means to correspond to a newly desired fuel flow; and, means for adjusting the output signal of said ratio means acccordingly so that said steam flow to said burner is modified to correspond to the predetermined ratios for the newly-desired fuel flow.

10. The control mechanism of claim 8 wherein said steam-flow control means includes means for sensing the actual flow of steam to said burner and is adapted to change the adjustment of said steam-flow value by an amount corresponding to that by which said actual steam flow varies from that corresponding to the predetermined ratio for the desired fuel flow.

11. The control mechanism of claim 10 including means for modifying the setting of said fuel-flow control means and thereby said fuel-flow valve to correspond to a newly desired fuel flow; and, means for adjusting the output signal of said ratio means accordingly so that said steam flow to said burner is modified to correspond to the predetermined ratios for the newly desired fuel flow.

12. The control mechanism of claim 7 wherein said steam-flow control means includes means for sensing the actual flow of steam to said burner and is adapted to change the adjustment of said steam-flow valve by an amount corresponding to that by which said actual steam flow varies from that corresponding to the predetermined ratio for the desired fuel flow.

13. The control mechanism of claim 12 including means for modifying the setting of said fuel-flow control means to correspond to a newly desired fuel flow; and means for adjusting the output signal of said ratio control means accordingly so that said steam flow to said burner is modified to correspond to the predetermined ratios for the newly-desired fuel flow.

14. The control mechanism of claim 7 including means to selectively direct one type of fuel or another to said fuel-flow valve; and wherein said ratio-control device is adapted to be adjusted accordingly.

15. A flow control mechanism for a rotary burner including:

a rotating member having perforated arms for directing a mixture of steam and fuel therefrom to cause said rotating member to rotate;

a fan member rotatable in response to rotation of said rotating member to cause air to mix with said steam and fuel mixture and project said steam and fuel into a flame zone;

fuel delivering means for delivering fuel to said rotating member;

steam delivering means for delivering steam to said rotating member;

a venturi in said steam delivering means;

connecting means at said venturi for connecting said venturi to said fuel deivering means; said venturi thereby being operative to cause said fuel to mix with said steam:

an adjustable fuel-flow valve for regulating the flow of fuel in said fuel delivering means;

fuel-flow control means for adjusting the position of said fuel-flow valve;

an adjustable steam-flow valve for regulating the flow of steam in said steam delivering means;

steam-flow control means for adjusting the position of said steam-flow valve; and, selectively settable ratio control means for providing an output signal to said steam-flow control means, there being a predetermined ratio of steam flow to fuel flow for any desired fuel flow within a given range of fuel flows, so that adjustment of said fuel-flow valve by said fuel-flow control means to deliver a desired amount of fuel to said burner, results in a corresponding steam flow to said burner in accordance with the predetermined ratio for the desired fuel flow, whereby variations in pressure at said venturi during operation at a given setting of said fuel-flow valve do not detrimentally affect the desired steam and fuel mixture that is projected into said flame zone.

* * * * *